US005699949A

United States Patent [19]

Marks

[11] Patent Number: 5,699,949

[45] Date of Patent: Dec. 23, 1997

[54] HEAVY DUTY FORWARD ACTING STAPLING MACHINE

[75] Inventor: Joel Steven Marks, Los Angeles, Calif.

[73] Assignee: WorkTools, Inc., Chatsworth, Calif.

[21] Appl. No.: 695,009

[22] Filed: Aug. 9, 1996

[51] Int. Cl.[6] ..... B25C 5/06

[52] U.S. Cl. ..... 227/132

[58] Field of Search ..... 227/132, 120, 227/125, 126, 139

[56] References Cited

U.S. PATENT DOCUMENTS

| | | | |
|---|---|---|---|
| 2,326,540 | 8/1943 | Krantz . | |
| 2,412,620 | 12/1946 | Kipp | 227/132 |
| 2,671,215 | 3/1954 | Abrams | 1/49 |
| 2,769,174 | 11/1956 | Libert | 1/49 |
| 3,610,505 | 10/1971 | Males et al. | 227/123 |
| 3,862,712 | 1/1975 | LaPointe et al. | 227/127 |
| 3,913,817 | 10/1975 | Barrett et al. | 227/132 |
| 4,452,388 | 6/1984 | Fealey | 227/132 |
| 4,629,108 | 12/1986 | Judge | 227/132 |
| 5,165,587 | 11/1992 | Marks | 227/132 |
| 5,407,118 | 4/1995 | Marks | 227/132 |
| 5,427,299 | 6/1995 | Marks | 227/132 |

*Primary Examiner*—Scott A. Smith

*Attorney, Agent, or Firm*—Paul Y. Feng; Fulwider Patton Lee & Utecht, LLP

[57] ABSTRACT

A manually powered fastening tool which stores and instantly releases the energy of a spring such that it may force a staple or other fastener into an object by an impact blow is disclosed. An actuating lever engages a plunger in an upward motion against a spring bias and in a sideways direction in a release motion. An arcing motion of the lever causes an element of the lever to rotate and slide rearward from the plunger and disengage from the plunger, thereby allowing the lever to slide sideways off an angled surface of the plunger. The plunger, once released and under spring bias, strikes a staple and drives the staple out from the tool into the object.

14 Claims, 5 Drawing Sheets

FIG. 4
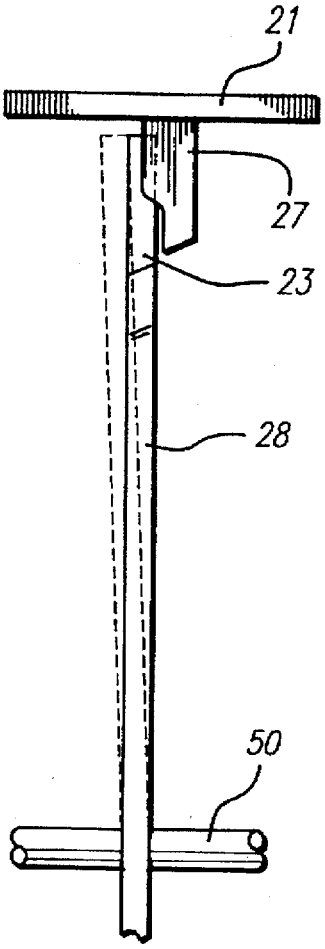
FIG. 5
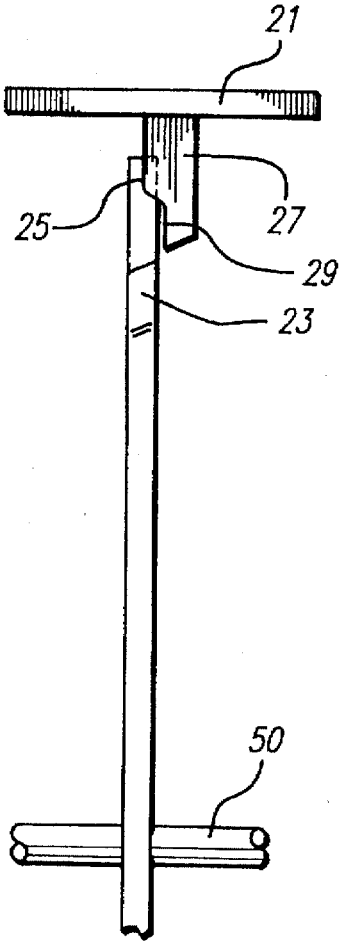
FIG. 7
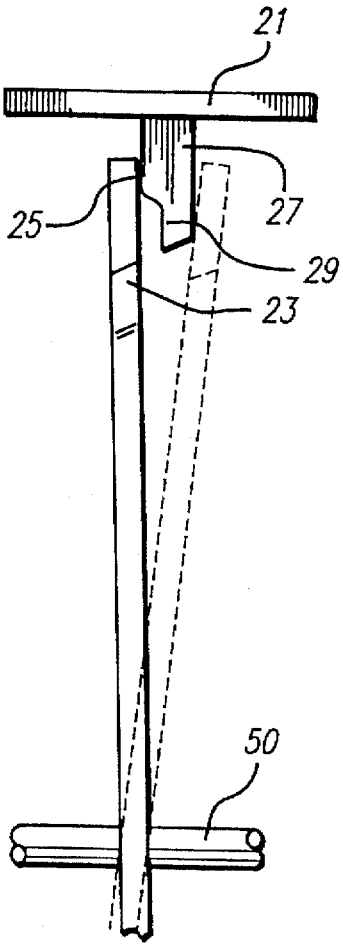
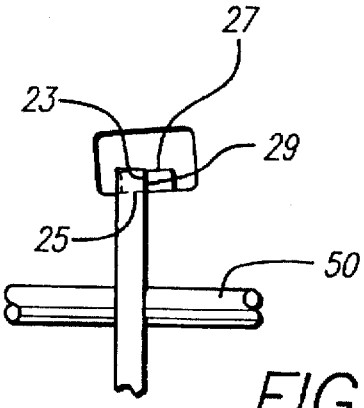
FIG. 6

FIG. 10
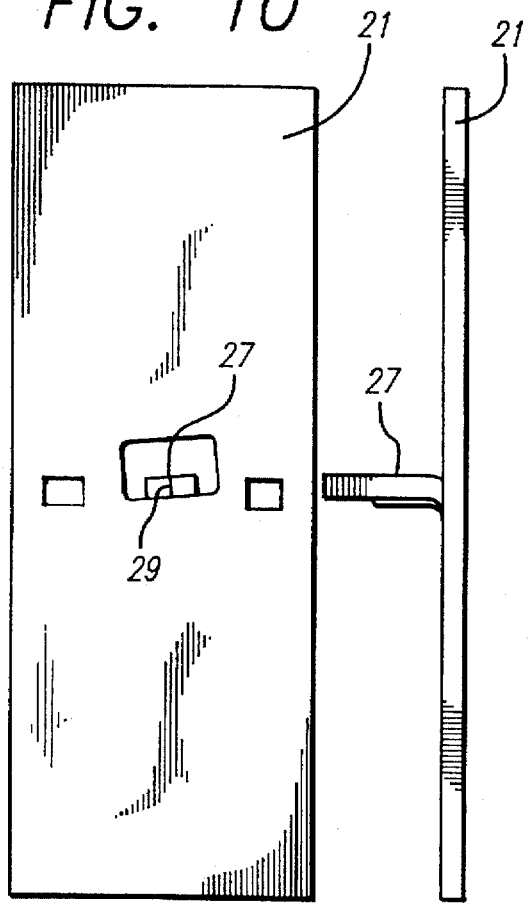
FIG. 11
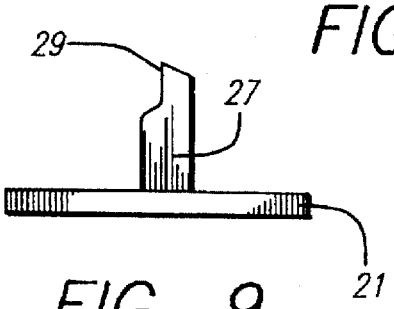
FIG. 9
FIG. 8
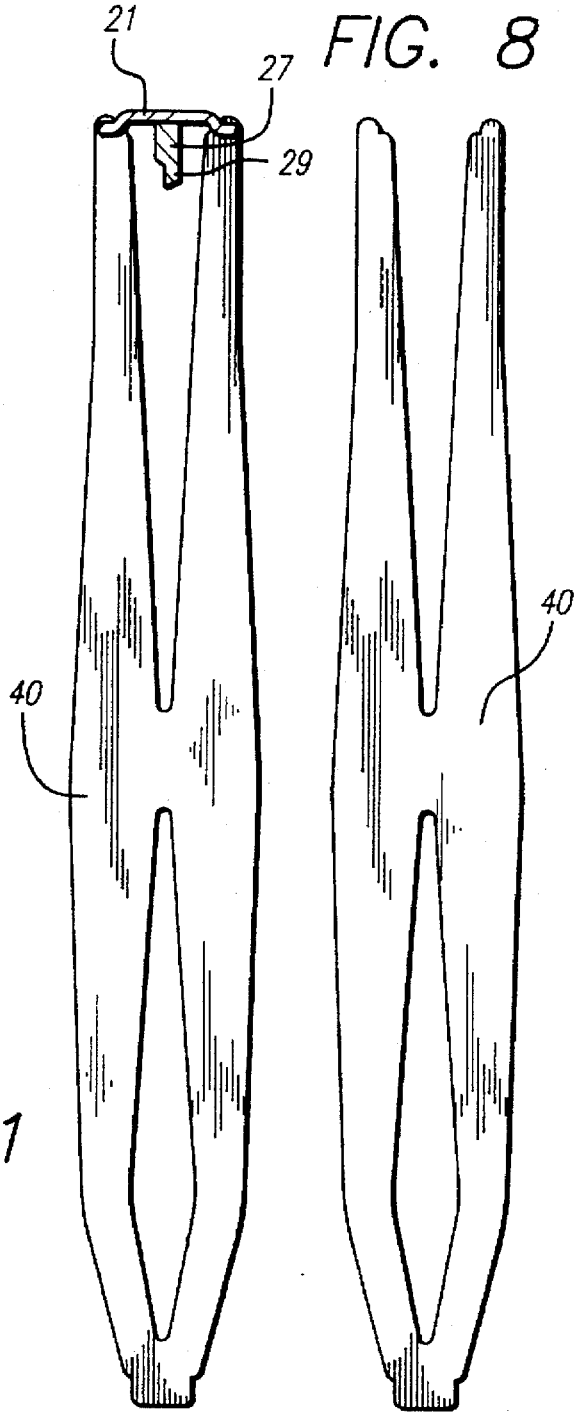
FIG. 12

HEAVY DUTY FORWARD ACTING STAPLING MACHINE

BACKGROUND OF THE INVENTION

1. Field of the Invention

The present invention generally relates to manually powered fastening devices. More specifically, the present invention relates to impact driven staple guns and tacking machines.

2. Description of the Related Art

The fastening tool of the present invention is similar to that disclosed in co-pending application U.S. Ser. No. 07/899,748 and U.S. Pat. No. 5,165,587. The fastening tool enables an operator's single hand to compress a spring to store and instantly release the energy of the spring to expel a staple from the fastening tool by an impact blow. The fastening tool incorporates a forward acting actuator lever. The staples exit towards the front end of the fastening tool while the lever is hinged near the rear end of the fastening tool. The tool may be gripped through an opening in the body of the tool. The opening extends to the front of the tool, and in certain configurations, the opening may originate at the front of the body of the tool.

U.S. Pat. No. 2,671,215 issued to Abrams discloses the familiar Arrow Stapler. A lever is pivoted towards the front of the staple gun. Pressing down the lever behind the pivot compresses a coil spring and raises a plunger through a pivotally attached actuating arm. At a predetermined point of the lever travel, the actuating arm has arced rearward sufficiently such that it releases the plunger assembly. The plunger is driven downwards by the force rearward sufficiently such that it releases the plunger assembly. The plunger is driven downwards by the force stored in the coil spring. The coil spring is located immediately adjacent to, or above, the plunger. The plunger is located in the front of the staple gun.

U.S. Pat. No. 3,610,505 issued to Males discloses a design similar to the Abrams design. A lever is pivoted near the front of a staple gun. Pressing the extended arm of the lever downwards towards the rear of the staple gun causes a coil spring to compress and simultaneously to raise a plunger. Once the lever has been lowered past a predetermined point, the lever is released from the coil spring and plunger assembly by the force of a cam assembly, and the force stored in the coil spring is allowed to drive the plunger downwards, striking and ejecting a staple. The plunger is located at the front of the staple gun.

U.S. Pat. No. 2,326,540 issued to Krantz discloses a staple gun in which the actuation lever is pivoted towards the rear of the staple gun. Through a series of levers, this action is connected to a coil spring and plunger located at the front of the staple gun. As the lever arm is lowered, the spring is compressed and the plunger is raised. A pivotable member of the spring and plunger assembly links the levers to the assembly. Once the lever reaches a predetermined point, the pivotable member is forcibly disengaged from the lifting lever, and the energy stored in the coil spring is allowed to release, driving the plunger downward, striking and expelling a staple.

U.S. Pat. No. 2,769,174 issued to Libert describes a staple gun in which the actuation lever is pivoted at a point towards the rear of the staple gun, and staples are expelled out of the front of the staple gun. Pressing down on the actuation arm towards the bottom of the staple gun actuates a series of levers and compresses a coil spring to raise the plunger. At a predetermined point, two of the levers are forcibly decoupled and the energy stored by the coil spring is allowed to release, driving the plunger downwards, striking and expelling a staple.

U.S. Pat. No. 4,629,108 issued to Judge describes a staple gun contained within a stamped metallic frame which is enclosed in a second stamped or molded housing. Judge further describes a common mechanism to accommodate an actuation lever pivoted near the rear of the staple gun. The release mechanism appears to be similar to that of Libert.

U.S. Pat. No. 3,862,712 issued to LaPointe et al. discloses a staple guiding track which slides rearward to expose a chamber in the staple gun body into which staples are placed. The staple gun is inverted during this operation. This sliding mechanism requires numerous components and assembly operations for its manufacture.

U.S. Pat. No. 4,452,388 issued to Fealy comprises a staple gun with an intermediately actuated leaf spring. The multi-layered leaf spring spans the length of the tool body. A mechanism pulls upward upon the spring to lift the spring and plunger. The mechanism is then forced away from the spring to release the spring from the actuating mechanism.

Typical of the prior art, most of the above described designs use either of two release methods. By one method a cam or stop acts upon a linking member to force a delinkage at the release position. By the other method a rotating actuating member is slidably linked to a reciprocating plunger member. At the release position the actuating member has rotated out of the plane of motion of the plunger member, and the plunger member is released.

The above release methods may be called active or direct releases because the release is forcibly and directly caused by the actuating members. The first method requires a substantial increase in operating force to enable the forced release action. The second method provides only a vague release action since there is no secondary event to cause the release. No distinct action occurs at the release position.

U.S. Pat. No. 5,407,118 issued to Marks, discloses a passive release mechanism in a staple gun. A component of the device holds an unstable engagement between an actuating lever and a plunger until a sharply defined release point. There is, however, still a need for an improved release method for a manually powered fastening device.

SUMMARY OF THE INVENTION

The present invention is directed to a manually powered fastening tool which stores and instantly releases the energy of a spring such that it may force a staple or other fastener into an object by an impact blow. In a preferred embodiment, an actuating lever engages and lifts a plunger in an upward motion against a spring bias and in a sideways or lateral motion to release the plunger. An arcing motion of the actuating lever causes an element of the lever to slide rearward from the plunger and disengage the plunger, thereby allowing the actuating lever to slide sideways off an angled surface of the plunger.

In the present invention, the actuating lever and plunger are directly engaged at two distinct surfaces of each component. A primary surface provides the vertical engagement by which the actuating lever raises the plunger against a spring force. But the primary surface is tilted to cause a bias upon the actuating lever so that the lever tends to slide laterally or sideways off the primary surface.

In the present invention, through an arcing motion the actuating lever raises the plunger. The arcing motion results in the actuating lever sliding rearward as it rotates away from the plunger when the plunger nears the top of its stroke. The face of the actuating lever slides rearward against the extended plunger tab accordingly. When the lever face passes the distal end of the plunger tab, the lever is free to slide sideways under the tilted lifting surface, resulting in a release action.

A reset mechanism enables the next cycle to occur. Thus, the sideways release and reset design of the present invention are embodied in a simple mechanism with minimal components.

Another advantage with the present invention is that the release surface, by virtue of being located only between the plunger and actuating lever, experiences low friction since the sideways forces generated in the system remain internal to the lever and plunger engagement area. Indeed, because sliding here is of a relatively small magnitude, the friction is also small.

As mentioned above, in the present invention, a secondary surface holds the primary engagement in place. Unlike the positioning component described in U.S. Pat. No. 5,407,118 to Marks, the secondary surface of the present invention is only between the actuating lever and the plunger. In contrast, the secondary surface of Marks '118 is some further component of the device. That is, the lever of Marks '118 releases against the tool housing interior or other further component. A sideways force is generated external to the lever/plunger pair resulting in these components being pressed sideways against the housing walls. This results in increased friction, and complicates the use of a soft material such as plastic for the housing because a plastic release surface is unlikely to wear well.

BRIEF DESCRIPTION OF THE DRAWINGS

FIG. 4 is a plan view of a lever forward portion and plunger, showing a pre-reset configuration in phantom lines and fully reset condition in solid lines.

FIG. 5 is the view of FIG. 4 wherein the actuating lever has lifted the plunger to the release position.

FIG. 6 is a rear elevational view of either the reset condition of FIG. 4, or the pre-release condition of FIG. 5.

FIG. 7 is the view of FIG. 5 where the lever has moved sideways, shown in phantom lines, to the release condition, and in solid has switched to a pre-reset condition.

FIG. 8 is a plan view of a flat spring.

FIG. 9 is an end elevational view of a plunger.

FIG. 10 is a top plan view of the plunger of FIG.

FIG. 11 is a side elevational view of the plunger of FIG. 9.

FIG. 12 is a plan elevational view of a flat spring engaging the plunger.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

Figure 1:
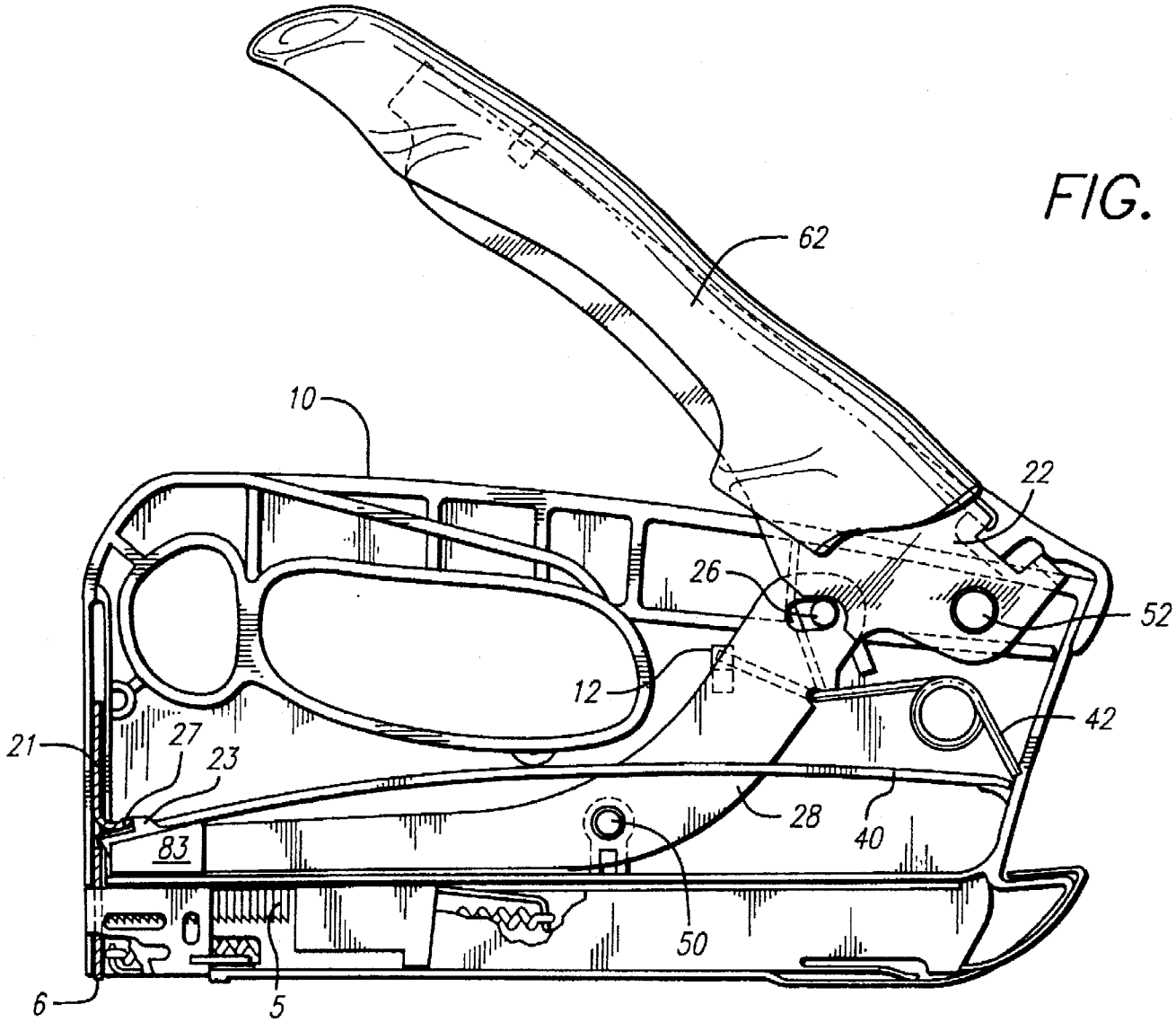
FIG. 1 is a side elevational view of a fastening tool, with one half of the housing removed, and with its hand lever in an extended position and a spring in its rest state, as the tool would appear before commencing an operating sequence.

FIG. 1 depicts a side elevational view of the present invention fastening device with one half of the housing 10 removed to expose the internal elements. The housing 10 consists of two opposing halves joined together to guide and hold the internal components of the fastening device.

Pivot 52 is a post near the rear of housing 10. Handle cover 62 fits over and covers the top portion of hand lever 22. Roller linkage 26 provides a connection between hand lever 22 and actuating lever 28. In the exemplary embodiment, the roller linkage 26 is loosely held in the kidney bean shaped opening in lever 28.

Figure 2:
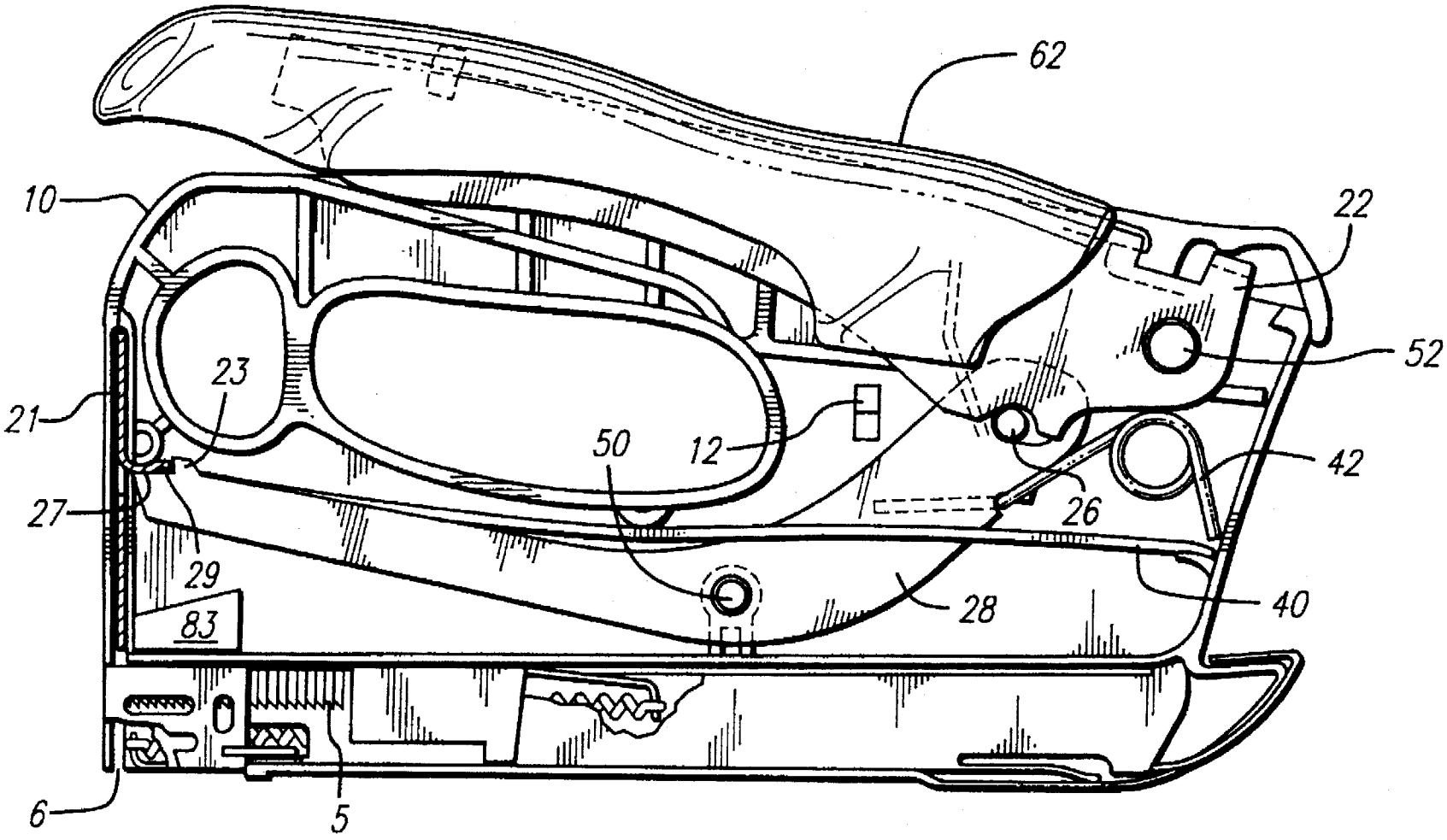
FIG. 2 is a side elevational view of the fastening tool of FIG. 1, with the hand lever fully drawn toward the tool body and spring energized as the tool would appear just prior to ejection of a staple.
Figure 3:
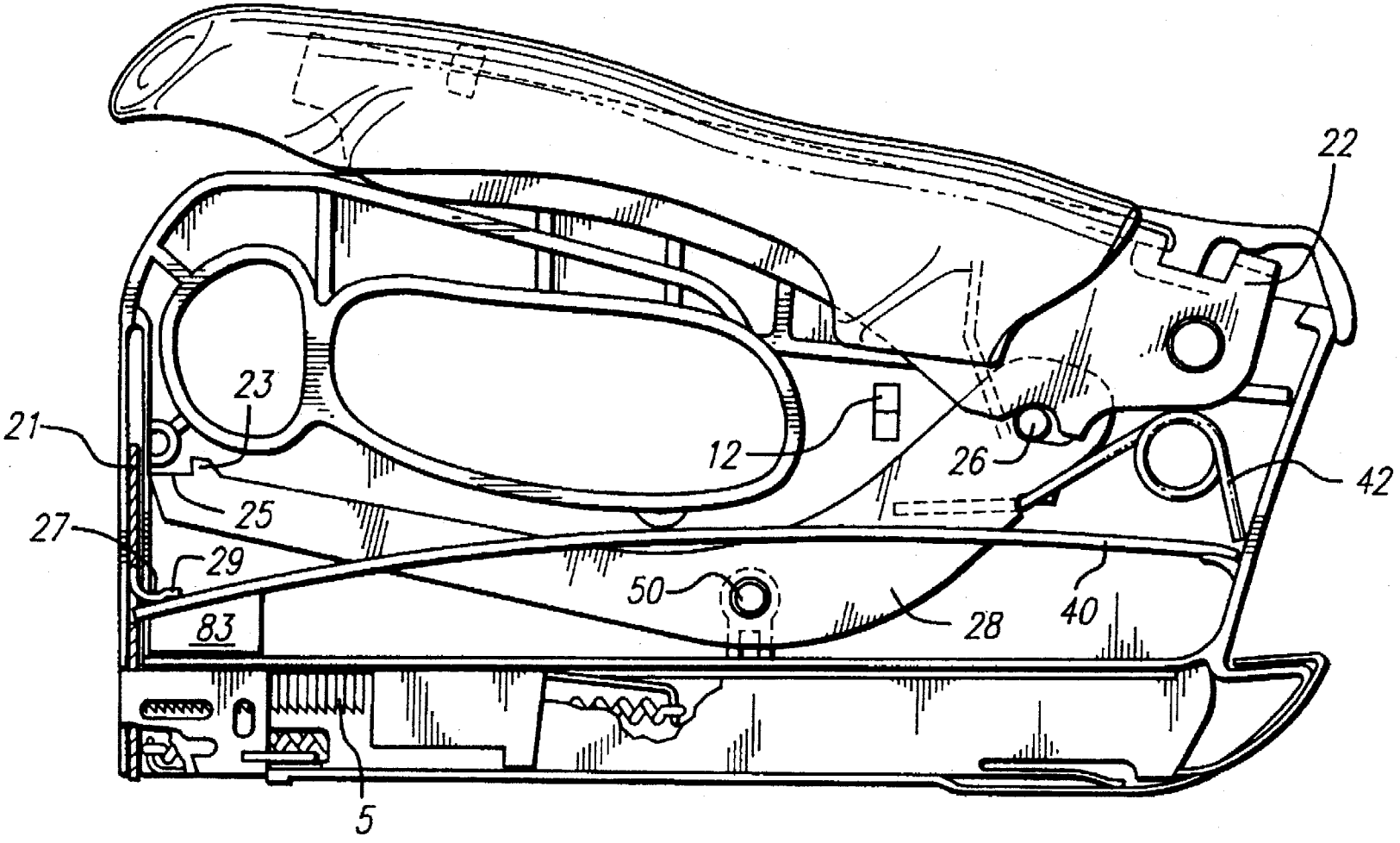
FIG. 3 is a side elevational view of the fastening tool of FIG. 1, with the spring in its rest state and the hand lever fully drawn toward the tool body, as the tool would appear just after ejection of a staple.

As seen in FIGS. 1–3, lever 28 pivots about pin 50 in a clockwise and a counterclockwise motion. In addition, as seen in FIGS. 1–3, lever 28 pivots about pin 50 in a lateral direction. That is, the front and rear ends of lever 28 pivot into and out of the paper, conceptually speaking.

A flat spring 40, shown in FIGS. 8 and 12, spans the length of housing 10. This supplies the spring force to drive the plunger 21 to expel a fastener or staple. Operation of the present invention fastening device is based on application of force to hand lever 22 by a user, which tilts lever 28, which in turn lifts and releases plunger 21 against the bias of flat spring 40. Along the bottom of the present invention tool is a staple storage and feeding section known in the art. A column of staples 5 is pushed forward under spring bias until each one is aligned beneath the plunger 21, just prior to being expelled from the housing 10. After being raised and released, the plunger 21 drops downward to strike a staple 5, which is then ejected out of opening 6.

The motion of levers 22 and 28 and plunger 21 are described in three stages: reset/raise, release, and return/reset. FIG. 4 is a plan view of the front end of lever 28, which is engaging tab 27 of plunger 21. FIG. 4 shows a pre-reset condition in phantom lines and fully reset condition in solid lines. FIG. 1 and FIG. 4 essentially show the same configuration of lever 28 and surrounding elements. At this moment, lever 28 is tilted below plunger tab 27. In FIG. 4, the solid lines show that lever 28 has shifted underneath tab 27 whereby lever 28 can lift plunger 21 by tab 27.

Still in the reset/raise stage, the reset bias to push lever 28 to the right in FIG. 4 is provided by action at the rear of lever 28, visible in FIGS. 1, 2 and 3. Specifically, the forward end of spring 42 rises up against the raised surface of cam 12 as lever 22 is raised. Referring to FIG. 1, this causes the rear edge of lever 28 to be pushed out of the page, conceptually speaking. Accordingly, the front of lever 28 is pushed into the page, conceptually speaking, or to the right in FIGS. 4 and 5. Spring 42 also provides the bias to raise lever 22.

In an alternative embodiment, the reset bias may be provided by a resilient element contacting lever 28 at the front. This resilient element is not shown, but could comprise an arm extending from relatively soft bumper 83. In either case, the bumper 83 or cam 12 are present to provide a lateral bias to lever 28 in FIGS. 1 and 4. This bias is present only when the front of lever 28 is near the bottom of its range of motion.

Force is now applied to lever 22 which, through pin 26, translates the back end of ever 26 clockwise about pin 50 as seen in FIG. 2. The front of lever 28 pivots upward, lifting the plunger 21 through contact of surface 25 with tab 27 of plunger 21, as seen in FIGS. 4 and 5.

As seen in the rear elevational view of FIG. 6, tab 27 is tilted so that as lever 28 lifts against tab 27 through surface 25, extension 23 of lever 28 presses against release tab 29. The tilt causes a lateral bias upon lever 28 in the same direction as that caused by cam 12 or the resilient arm of bumper 83 and preserves the engagement of lever 28 and plunger 21 as lever 28 rotates out of contact with cam 12 or the reset arm. FIG. 6 corresponds to the view of FIG. 2. Plunger 21 has been raised to its release position and the front of lever 28 has arced upward and rearward. At this release stage, extension 23 of lever 28 has rotated out of contact with release tab 29; in other words, the arced motion of lever 28 has caused extension 23 to clear tab 29, which moves vertically. This instant in time is depicted in FIG. 5.

Once extension 23 is free of tab 29, lever 28 instantaneously slides to the right, as shown in the phantom lines of FIG. 7. This occurs as a result of the tilt of tab 27 and the downward pressure of the plunger 21, as best seen in the rear elevational view of FIG. 6. The release stage of lever 28 shown in phantom lines in FIG. 7 lasts only for an instant, because spring 42 is mounted so as to provide a gentle out-of-plane bias to lever 28, to force the front end of lever 28 to the left in FIG. 7, or out of the page in FIG. 3.

Lever 28 under this spring 42 bias is shown in solid lines in FIG. 7. Importantly, the bias of spring 42 directing the back end of lever 28 into the page in FIG. 3, or the front end of lever 28 to the left in FIG. 7, is opposite from and less than both the reset bias described above and the bias caused by the tilt of tab 27.

It is not required that release tab 29 be immediately attached to tab 27. In an alternative embodiment, not shown, tab 29 could be a sideways facing surface of plunger 21 separate from tab 27. Extension 23 would be appropriately located to engage this sideways facing surface. The limitation is that this engagement must be substantially above pivot pin 50 within housing 10 when plunger 21 is in its uppermost position. This geometry is needed so that lever 28 arcs rearward from plunger 21 at the chosen engagement location of extension 23. For example, the release would be less effective if an extension 23 were positioned below tab 27 in FIG. 2.

The return/reset stage is depicted going from FIG. 7 to FIG. 4 and FIG. 3 to FIG. 1, wherein spring 42 raises the front of lever 22, and simultaneously slides the forward end of spring 42 over the raised crest of cam 12. This in turn moves the front end of lever 28 to the right as shown in FIG. 4, as first phantom lines and then solid lines.

In FIG. 10, the tilt of tab 27 is visible, relative to the rectilinear shape of the plunger 21. FIG. 12 shows a permanent engagement between plunger 21 and spring 40. Spring 40 could alternatively be a coiled wire spring or other resilient energy storage element known in the art.

The engaging surfaces of extension 23 and release tab 29 are preferably angled to reduce the likeliness of jamming. For example, if lever 28 fails to fully, slidably release under tab 27, the angled relationship forces lever 28 to slide past tab 27 when lever 28 and plunger 21 are slowly lowered by allowing lever 22 to rise.

The foregoing describes a novel fastening device. Those skilled in the art may now make numerous uses of the teachings of the present invention without departing from the spirit of the present invention, which is defined by the scope of the following claims.

What is claimed is:

1. A fastening device comprising:

a housing body to support and guide functional components;

a fastener guide section attached to the housing near a bottom thereof, to guide fasteners toward a front of the housing;

a plunger located toward the front of the housing, the plunger oriented to expel fasteners in the fastener guide section out of the fastening device, the plunger further having attached a tab extending in a rearward direction;

said tab having first and second side edges, a bottom face of the tab angled at least in part between the first and second edge so that the first edge is in a lower position than the second edge;

a spring linked to the plunger, oriented to force the plunger toward the bottom of the housing;

a first surface of an actuating lever engaging the angled bottom face;

a second surface of the actuating lever engaging a third sideways facing edge of the plunger, the angled surface of the bottom face causing the second surface of the actuating lever to press the third edge when the actuating lever is pressed upward against the plunger tab;

said actuating lever pivotally attached to the housing body so that, as a front end of the actuating lever is rotated upward, the front end rotates along an arc within the housing body and slides rearward in contact with the tab as the plunger moves upward within the housing body;

the actuating lever further mounted within the housing body so that the front end is free to move from side to side;

in an uppermost position of the plunger, the second surface of the actuating lever is moved immediately rearward of the third sideways facing edge and ceases to engage the third edge;

said first surface of the actuating lever instantly slidably disengaging the angled bottom face of the tab by moving in a direction from the first side edge to past the second side edge.

2. The fastening device of claim 1 in which said angled tab bottom face faces substantially vertically downward toward said fastener guide section such that the bottom face is angled away from a vertical direction by not more than 45 degrees.

3. The fastening device of claim 1 in which said first and second side edges define a main segment of said tab and said third sideways facing edge comprises one edge of a further segment of the tab, and in which the further segment is positioned to the rear of the main segment.

4. The fastening device of claim 3 in which said main segment is wide between said first and second side edges, and said further segment is narrow in relation to the main segment.

5. The fastening device of claim 4 in which said actuating lever front end is a substantially flat sheet metal form, said first surface of the actuating lever engages the tab under the wide main segment and said second surface of the actuating lever engages the tab at said one edge of said narrow further segment.

6. A fastening device comprising:

a housing having a front, a back, a top, a bottom, and a fastener opening at the bottom and proximate to the front;

a hand lever having a front end and a back end, wherein the back end is pivoted at the back of the housing;

an actuating lever having a front end including a top surface, a mid-portion, and a back end, wherein the back end engages the hand lever at the back end;

a pivot, connecting the mid-portion of the actuating lever to the housing to obtain rotation of the actuating lever about the pivot and lateral pivoting of the actuating lever about the pivot;

a first spring biased against the back end of the actuating lever to force the actuating lever in the lateral direction;

a plunger slidably disposed at the front of the housing, wherein the plunger includes a tab having an angular tilt relative to the bottom of the housing, the tab slidably engaging the front end top surface of the actuating lever and wherein the angular tilt tends to slide the front end of the actuating lever against the bias of the first spring;

a second spring biasing the plunger toward the bottom of the housing;

a fastener positioned beneath the plunger to be struck thereby and pushed out of the housing through the fastener opening when the plunger is biased toward the bottom of the housing; and wherein the tab includes a vertical surface engaging a vertical surface of the front end of the actuating lever thereby opposing a lateral force from the tilted tab, whereby during rotation of the actuating lever, the vertical surface of the tab slidably disengages from the vertical surface of the actuating lever, releasing the actuating lever to move laterally under the lateral force;

whereby moving the hand lever rotates the actuating lever so that the front end top surface lifts the plunger toward the top of the housing against the bias of the second spring, and the angular tilt in the tab slides the front end of the actuating lever against the bias of the first spring and decouples the front end top surface of the actuating lever from the tab, thereby releasing the plunger, which plunger is biased by the second spring toward the bottom of the housing to strike the fastener.

7. The fastening device of claim 6, wherein the housing includes a cuneiform cam and a distal end of the first spring slides therealong against the bias of the first spring.

8. The fastening device of claim 6, wherein the second spring includes a flat, cantilevered spring.

9. The fastening device of claim 6, wherein the front end of the actuating lever includes a soft bumper.

10. The fastening device of claim 6, wherein the actuating lever further comprises a kidney-shaped opening at the back end loosely containing a cylindrical pin engaging the back end of the hand lever.

11. A process for triggering a fastening device, comprising the steps of:

providing a housing having a front, a back, and a bottom;

providing a hand lever pivoted to the housing at a back end;

providing an actuating lever that is pivoted to the housing to obtain rotational and lateral pivoting motions, and engaging the hand lever;

providing a vertically sliding plunger at the front of the housing, the plunger including a tilted surface of a tab engaging the actuating lever to bias the actuating lever in a lateral direction;

biasing the plunger toward the bottom of the housing;

positioning a fastener beneath the plunger to be expelled through an opening in the housing bottom;

compressing the hand lever to partially rotate the actuating lever, thereby raising the plunger;

providing a lateral obstruction at the front end of the actuating lever that engages the plunger and opposes the lateral bias; and rotating the actuating lever by compressing the hand lever, wherein the lateral obstruction of the actuating lever disengages from the plunger, thereby allowing the actuating lever to be biased in the lateral direction and the plunger to slide vertically under spring bias to expel the fastener.

12. The process of claim 11, wherein the process further comprises the steps of providing a raised cam within the housing, moving a resilient member against the cam to move the actuating lever in the lateral direction.

13. The process of claim 12, wherein the resilient member includes a spring.

14. The process of claim 11, wherein the steps of rotating the actuating lever and biasing the actuating lever in the lateral direction occur concurrently.

* * * * *